US008497833B2

(12) United States Patent
Park

(10) Patent No.: US 8,497,833 B2
(45) Date of Patent: Jul. 30, 2013

(54) DISPLAY DEVICE

(75) Inventor: Ok-Kyung Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 700 days.

(21) Appl. No.: 12/780,609

(22) Filed: May 14, 2010

(65) Prior Publication Data

US 2011/0025679 A1 Feb. 3, 2011

(30) Foreign Application Priority Data

Jul. 31, 2009 (KR) ..... 10-2009-0070936

(51) Int. Cl.
*G09G 3/36* (2006.01)

(52) U.S. Cl.
USPC ..... 345/100; 377/64; 340/12.21; 315/169.2

(58) Field of Classification Search
USPC .. 315/169.2; 340/12.21; 345/100; 377/64–81
See application file for complete search history.

(56) References Cited

FOREIGN PATENT DOCUMENTS

KR 10-0624115 B1 9/2006
KR 10-0646992 B1 11/2006
KR 10-2008-0082280 A 9/2008

*Primary Examiner* — Michael Pervan
(74) *Attorney, Agent, or Firm* — Christie, Parker & Hale, LLP

(57) ABSTRACT

A display device includes a light emission driver realized by using PMOS transistors, thereby controlling a light emitting time. The display device includes: a display unit including a plurality of scan lines for transmitting a plurality of scan signals, a plurality of data lines for transmitting a plurality of data signals, a plurality of light emitting signal lines for transmitting a plurality of light emitting signals, and a plurality of pixels coupled to the scan lines and the data lines and for emitting light according to the light emitting signals; and a light emission driver for transmitting the light emitting signals to the light emitting signal lines and for controlling a pulse width of the light emitting signals.

17 Claims, 5 Drawing Sheets

DISPLAY DEVICE

CROSS-REFERENCE TO RELATED PATENT APPLICATION

This application claims priority to and the benefit of Korean Patent Application No. 10-2009-0070936 filed in the Korean Intellectual Property Office on Jul. 31, 2009, the entire content of which is incorporated herein by reference.

BACKGROUND

1. Field

The described technology relates generally to a display device. More particularly, the described technology relates to an organic light emitting diode (OLED) display.

2. Description of the Related Art

A display device includes a plurality of pixels, arranged on a substrate in the form of a matrix, which form a display area, and scan and data lines connected to the respective pixels. Data signals are selectively applied to the pixels to display desired images. The display devices are classified into light emitting devices of passive or active matrix types, depending upon the method of driving the pixels. In terms of resolution, contrast, and response time, the current trend is toward the active matrix type, where respective unit pixels are selectively turned on or off.

A display device is used, for example, as a display unit for a personal computer, a portable phone, a PDA, and other mobile information devices, or as a monitor for various kinds of information systems. A liquid crystal panel-based display (LCD), an organic light emitting diode (OLED) display, a plasma display panel-based (PDP) device, etc., are well known examples of display devices.

The above information disclosed in this Background section is only for enhancement of understanding of the background of the described technology and therefore it may contain information that does not form the prior art that is already known in this country to a person of ordinary skill in the art.

SUMMARY

Embodiments of the present invention provide a display device to control light emitting time when realizing a light emission driver by using PMOS transistors only.

According to an exemplary embodiment of the present invention, a display device is provided. The display device includes a display unit and a light emission driver. The display unit includes a plurality of scan lines for transmitting a plurality of scan signals, a plurality of data lines for transmitting a plurality of data signals, a plurality of light emitting signal lines for transmitting a plurality of light emitting signals, and a plurality of pixels coupled to the scan lines and the data lines and for emitting light according to the light emitting signals. The light emission driver is for transmitting the light emitting signals to the light emitting signal lines, and for controlling a pulse width of the light emitting signals. The light emission driver is configured to receive a synchronization signal for limiting a maximum value of a driving current flowing to the pixels, a first light emitting clock signal in synchronization with the synchronization signal, a second light emitting clock signal in synchronization with the synchronization signal and having the same frequency as the first light emitting clock signal and a phase difference from the first light emitting clock signal, a clock signal having the same frequency as the first light emitting clock signal, and an inverted clock signal of the clock signal. In addition, the light emission driver is configured to sequentially generate a plurality of first light emitting signals during a plurality of first light emitting clock signal periods, and generate a plurality of first inverted light emitting signals by sampling the clock signal during the first light emitting clock signal periods, in synchronization with edge timing of the first light emitting clock signal. The light emission driver is also configured to sequentially generate a plurality of second light emitting signals during a plurality of second light emitting clock signal periods, and generate a plurality of second inverted light emitting signals by sampling the inverted clock signal during the second light emitting clock signal periods, in synchronization with edge timing of the second light emitting clock signal.

According to another exemplary embodiment, another display device is provided. This display device includes a display unit, a plurality of first light emitting signal generators, and a plurality of second light emitting signal generators. The display unit includes a plurality of scan lines for transmitting a plurality of scan signals, a plurality of data lines for transmitting a plurality of data signals, a plurality of light emitting signal lines for transmitting a plurality of light emitting signals, and a plurality of pixels coupled to the scan lines and the data lines and for emitting light according to the light emitting signals. The plurality of first light emitting signal generators is for generating a plurality of first light emitting signals of the light emitting signals corresponding to odd-numbered light emitting signal lines of the light emitting signal lines. The plurality of second light emitting signal generators is for generating a plurality of second light emitting signals of the light emitting signals corresponding to even-numbered light emitting signal lines of the light emitting signal lines. One of the first light emitting signal generators is configured to control a pulse width of one of the first light emitting signals by using a first light emitting clock signal, and one of the second light emitting signals from one of the second light emitting signal generators. One of the one of the second light emitting signal generators is configured to control a pulse width of the one of the second light emitting signals by using a second light emitting clock signal having a same frequency as the first light emitting clock signal and a phase difference from the first light emitting clock signal, and an other of the first light emitting signals from an other of the first light emitting signal generators.

According to embodiments of the present invention, although the light emission driver is realized using only PMOS transistors, the light emitting time may be arbitrarily controlled.

DETAILED DESCRIPTION

Figure 1:
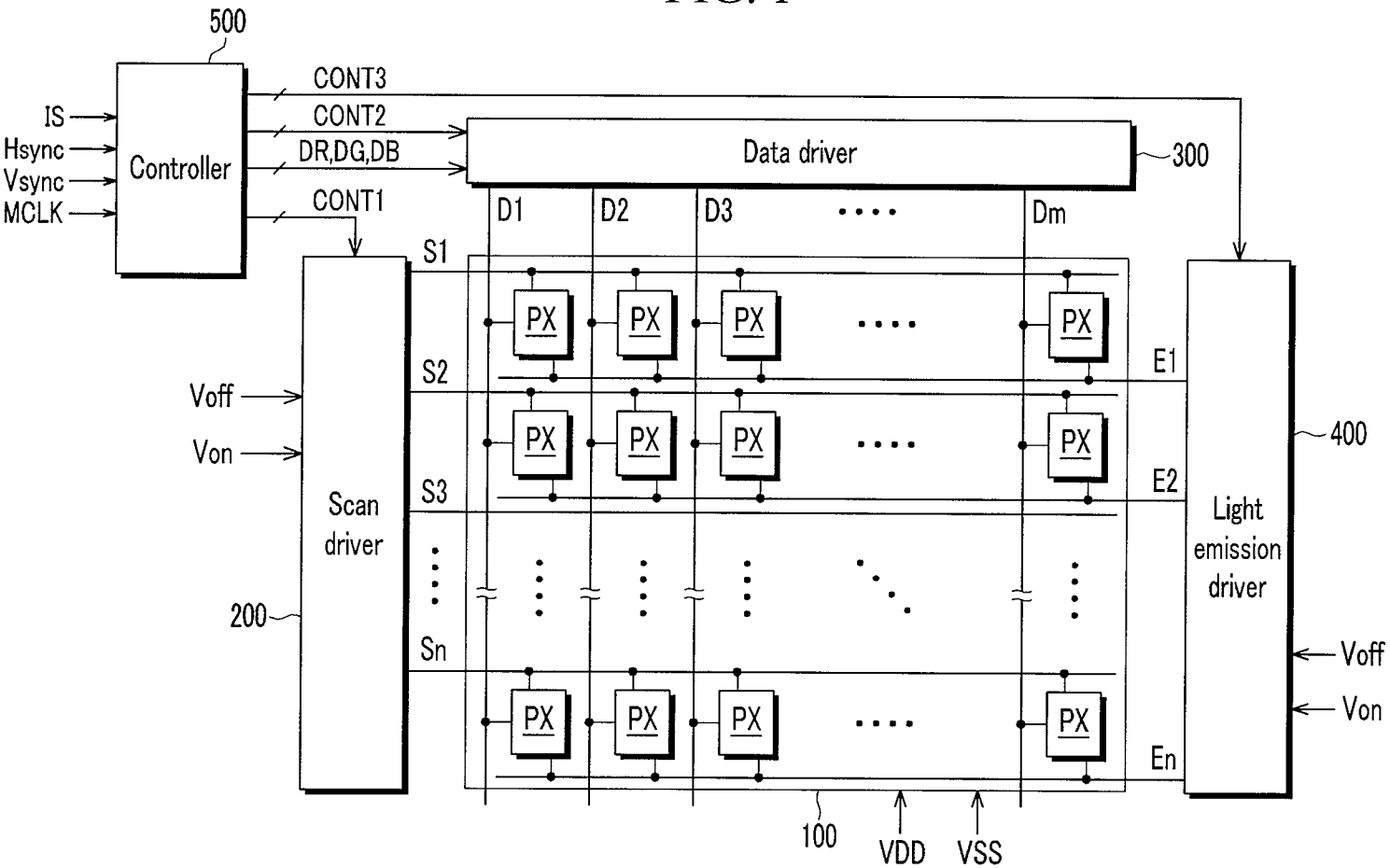
FIG. 1 is a block diagram of a display device according to an exemplary embodiment.

In the following detailed description, certain exemplary embodiments have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through one or more elements. In addition, unless explicitly described to the contrary, the word "comprise" and variations such as "comprises" or "comprising" will be understood to imply the inclusion of stated elements but not the exclusion of any other elements.

To reduce the power consumption of the organic light emitting diode (OLED) display, when the video signal of one frame illuminates the whole screen with a high luminance, a control method (automatic current limit, "ACL") that reduces the luminance of the whole screen by controlling the current, is used. In the ACL method, for each frame, the total data values for displaying the organic electro-luminescence display panel are added to determine an average luminance value of the organic electro-luminescence display panel for that frame. Then a light emitting time is equally supplied to the pixels of the organic electro-luminescence display panel during that frame according to the average luminance value. To control the light emitting time of the organic electro-luminescence display panel, the driver is realized by using NMOS transistors or PMOS transistors. However, when the driver is realized through PMOS transistors, it is difficult to arbitrarily control the light emitting time. That is, ACL is difficult to implement with PMOS transistors.

Figure 2:
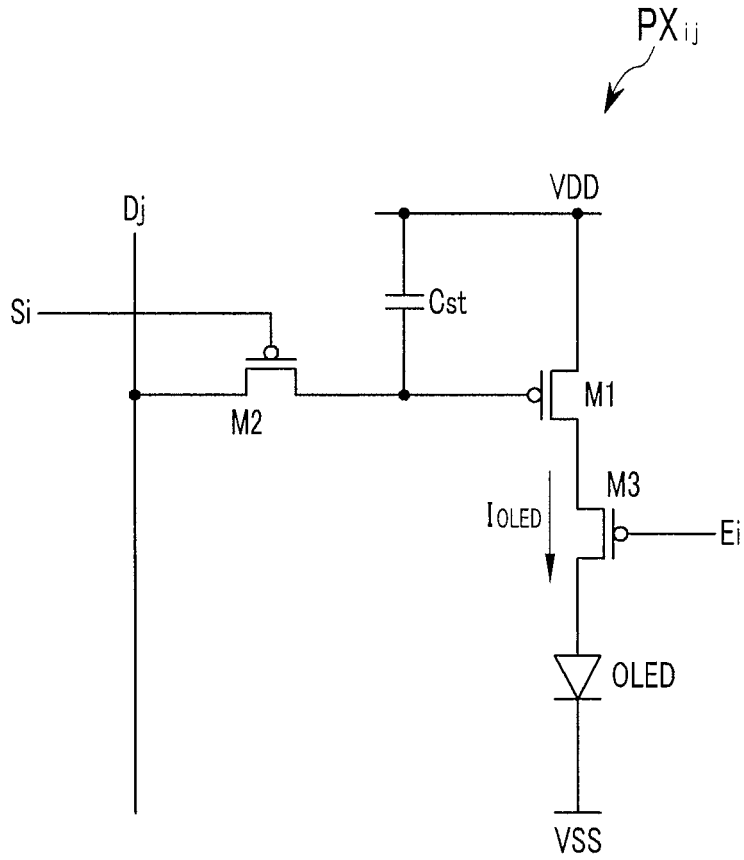
FIG. 2 is an equivalent circuit of a pixel PX shown in FIG. 1.

FIG. 1 is a block diagram of a display device according to an exemplary embodiment, and FIG. 2 is an equivalent circuit of a pixel PX shown in FIG. 1.

Referring to FIG. 1, a display device according to one embodiment includes a display unit 100, a scan driver 200, a data driver 300, a light emission driver 400, and a controller 500 (also referred to as a signal controller). The display unit 100 includes a plurality of signal lines S1-Sn, D1-Dm, and E1-En, and a plurality of pixels PX that are coupled thereto and that are arranged in substantially a matrix form. The signal lines S1-Sn, D1-Dm, and E1-En include a plurality of scan lines S1-Sn that transfer gate signals, a plurality of data lines D1-Dm that transfer data voltages, and a plurality of light emitting signal lines E1-En that transfer light emitting signals. The scan lines S1-Sn and the light emitting signal lines E1-En extend substantially in a row direction and are substantially parallel to each other, and the data lines D1-Dm extend substantially in a column direction and are substantially parallel to each other.

Referring to FIG. 2, each pixel PX, for example, a pixel PXij that is coupled to an i-th (i=1, 2, . . . , n) scan line Si and light emitting signal line Ei, and a j-th (j=1, 2, . . . , m) data line Dj, includes an organic light emitting diode OLED, a driving transistor M1, a capacitor Cst, a switching transistor M2, and a light emission control transistor M3.

The driving transistor M1 has a control terminal, an input terminal, and an output terminal. The control terminal is coupled to the switching transistor M2, the input terminal is coupled to a driving voltage VDD, and the output terminal is coupled to the organic light emitting diode OLED through the light emission control transistor M3. The driving transistor M1 outputs an electric current $I_{OLED}$ that varies in magnitude according to voltages held between the control and input terminals.

The switching transistor M2 has a control terminal, an input terminal, and an output terminal. The control terminal of the switching transistor M2 is coupled to the scan line Si, while the input terminal of the switching transistor M2 is coupled to the data line Dj and the output terminal of the switching transistor M2 is coupled to the control terminal of the driving transistor M1. The switching transistor M2 transmits a data signal, that is, a data voltage, from the data line Dj in response to a scan signal applied to the scan line Si.

The capacitor Cst is coupled between the control and input terminals of the driving transistor M1. The capacitor Cst charges the data voltage applied to the control terminal of the driving transistor M1, and stores it even after the switching transistor M2 turns off.

The light emission control transistor M3 has a control terminal, an input terminal, and an output terminal. The control terminal is coupled to the light emitting signal line Ei, the input terminal is coupled to the output terminal of the driving transistor M1, and the output terminal is coupled to the organic light emitting diode OLED. The light emission control transistor M3 receives a light emitting signal EMi through the light emitting signal line Ei, thereby turning on and causing the electric current $I_{OLED}$ to flow from the driving transistor M1 to the organic light emitting diode OLED.

The organic light emitting diode OLED has an anode coupled to the output terminal of the light emission control transistor M3 and a cathode coupled to a common voltage VSS. The organic light emitting diode OLED emits light that varies in intensity according to the electric current $I_{OLED}$ supplied from the driving transistor M1, as controlled by the light emission control transistor M3, so as to display an image.

The organic light emitting diode OLED may emit light of one of a plurality of primary colors. The primary colors may be, for example, the three primary colors of red, green, and blue, and the desired color may be expressed by a spatial or temporal sum of these three primary colors. Some of the organic light emitting diodes OLED may emit light of a white color to increase the luminance. In another embodiment, the organic light emitting diodes OLED of the pixels PX may emit light of a white color. In this case, at least some of the pixels PX may further include a color filter (not shown) for converting the white-colored light from the organic light emitting diodes OLED into one of the primary colors.

The driving transistor M1, the switching transistor M2, and the light emission control transistor M3 are, for example, each a p-channel field effect transistor (FET). In this case, the control terminal, the input terminal, and the output terminal correspond to the gate, the source, and the drain, respectively. In other embodiments, at least one of the switching transistor M2, the driving transistor M1, or the light emission control transistor M3 may be an n-channel field effect transistor. Furthermore, the interconnection relationship between the transistors M1, M2, and M3, the capacitor Cst, and the organic light emitting diode OLED may be different in other embodiments. The pixel PXij shown in FIG. 2 illustrates a pixel of a display device. In other embodiments, a pixel having a different structure with at least two transistors or at least one capacitor may be used instead.

Referring back to FIG. 1, the scan driver 200 is coupled to the scan lines S1 to Sn of the display unit 100, and sequentially applies scan signals to the scan lines S1 to Sn in accordance with scan control signals CONT1. The scan signals include a gate-on voltage Von for turning on the switching transistor M2, and a gate-off voltage Voff for turning off the switching transistor M2. In case the switching transistor M2 is a p-channel field effect transistor, the gate-on voltage Von and the gate-off voltage Voff are low and high voltages, respectively.

The data driver 300 is coupled to the data lines D1 to Dm of the display unit 100, and converts data signals DR, DG, and DB input from the signal controller 500 into data voltages in accordance with data control signals CONT2 so as to apply them to the data lines D1 to Dm.

The light emission driver 400 is coupled to the light emitting signal lines E1-En of the display unit 100, and sequentially applies a plurality of light emitting signals EM1-EMn to the light emitting signal lines E1-En in accordance with light emission control signals CONT3. The light emission driver 400 controls a pulse width of the light emitting signals EM1-EMn in accordance with the light emission control signals CONT3, and outputs them. The light emitting signals EM1-EMn include a gate-on voltage Von for turning on the light emission control transistor M3, and a gate-off voltage Voff for turning off the light emission control transistor M3. In case the light emission control transistor M3 is a p-channel field effect transistor, the gate-on voltage Von and the gate-off voltage Voff are low and high voltages, respectively. The light emission driver 400 may be formed with PMOS transistors, and details of such a configuration will be described below with reference to FIG. 4.

The controller 500 receives an input signal IS, a horizontal synchronization signal Hsync, a vertical synchronization signal Vsync, and a main clock signal MCLK from the outside to generate the image data signals DR, DG, and DB, the scan control signals CONT1, the data control signals CONT2, and the light emission control signals CONT3. The scan control signals CONT1 include a scan start signal STV for starting the scan, and at least one clock signal for controlling the output cycle of the gate-on voltage Von. The scan control signals CONT1 may further include an output enable signal OE for defining the duration of the gate-on voltage Von. The data control signals CONT2 include horizontal synchronization start signals STH for informing the data driver 300 of the transmission of the image data signals DR, DG, and DB with respect to a row of pixels PX, and load signals LOAD for applying data voltages to the data lines D1 to Dm.

Also, the light emission control signals CONT3 according to an exemplary embodiment include a synchronization signal FLM, an inverted synchronization signal FLM_B, first and second light emitting clock signals EM_CLK1 and EM_CLK2, a clock signal CLK, and an inverted clock signal CLKB. The synchronization signal FLM has a pulse having high level during a predetermined period as a signal to control a maximum value of the driving current flowing to the pixels PX. The first and second light emitting clock signals EM_CLK1 and EM_CLK2 have the same frequency and are generated in synchronization with the synchronization signal FLM. The second light emitting clock signal EM_CLK2 has a predetermined phase difference from the first light emitting clock signal EM_CLK1. The clock signal CLK has the same frequency as the first light emitting clock signal EM_CLK1.

Figure 3:
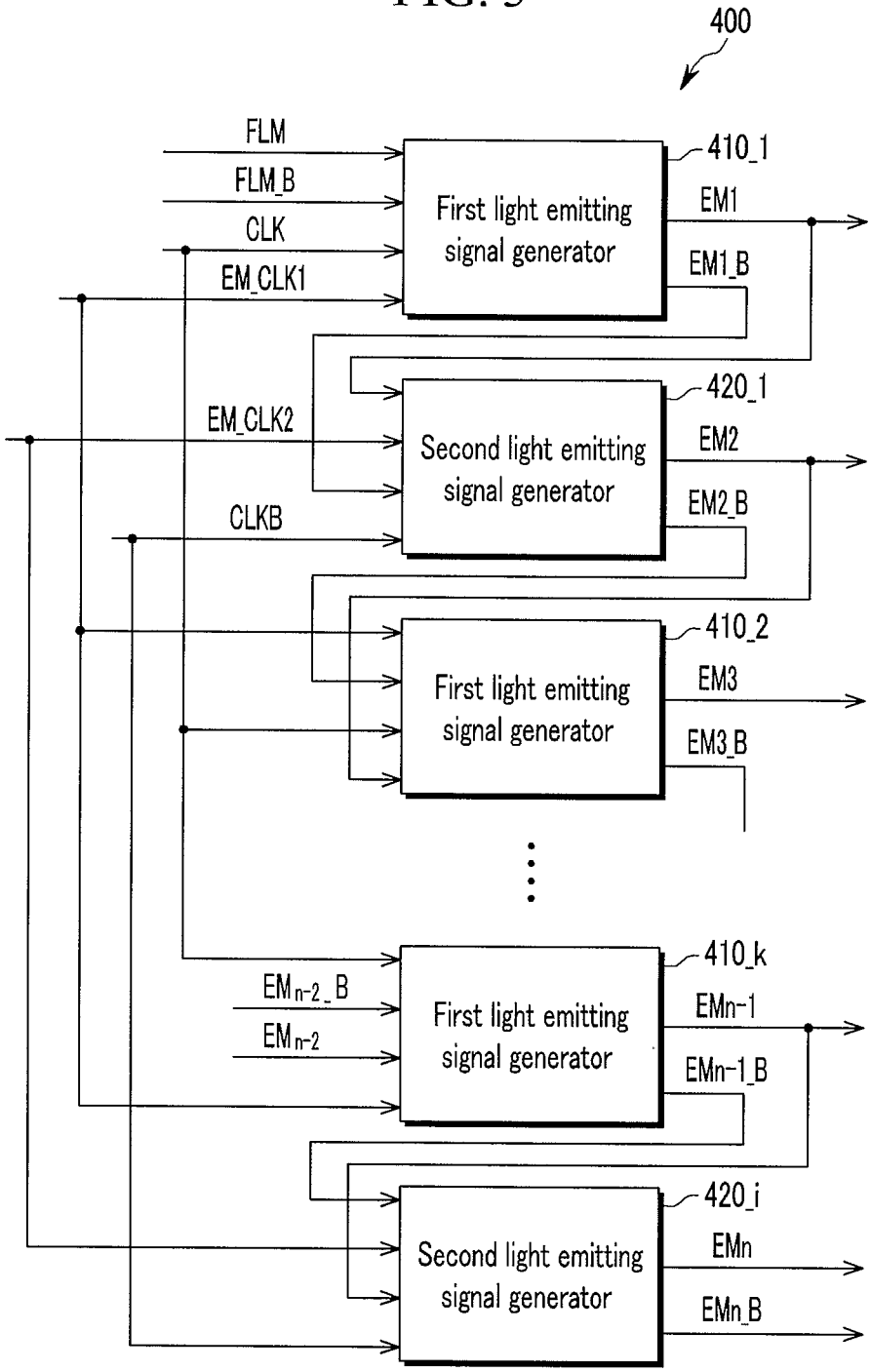
FIG. 3 is a block diagram of the light emission driver 400 shown in FIG. 1.

FIG. 3 is a block diagram of the light emission driver 400 shown in FIG. 1.

Referring to FIG. 3, the light emission driver 400 includes a plurality of first and second light emitting signal generators 410_1-410_*k* and 420_1-420_*i*. The light emission driver 400 according to an exemplary embodiment includes a plurality of first light emitting signal generators 410_1-410_*k* for generating a plurality of odd-numbered light emitting signals of the light emitting signals EM1-EMn, and a plurality of second light emitting signal generators 420_1-420_*i* for generating a plurality of even-numbered light emitting signals of the light emitting signals EM1-EMn. The first light emitting signal generators 410_1-410_*k* are input with the first light emitting clock signal EM_CLK1 and the clock signal CLK, and the second light emitting signal generators 420_1-420_*i* are input with the second light emitting clock signal EM_CLK2 and the inverted clock signal CLKB.

The first light emitting signal generators 410_1-410_*k* are synchronized to edge timing of the first light emitting clock signal EM_CLK1 for sequentially generating the odd-numbered light emitting signals as pulse signals corresponding to sequential periods of the first light emitting clock signal EM_CLK1, and for sampling the clock signal CLK during the corresponding periods of the first light emitting clock signal EM_CLK1 to sequentially generate odd-numbered inverted light emitting signals. Likewise, the second light emitting signal generators 420_1-420_*i* are synchronized to edge timing of the second light emitting clock signal EM_CLK2 for sequentially generating the even-numbered light emitting signals as pulse signals corresponding to sequential periods of the second light emitting clock signal EM_CLK2, and for sampling the inverted clock signal CLKB during the corresponding periods of the second light emitting clock signal EM_CLK2 to sequentially generate even-numbered inverted light emitting signals.

In general, each of the first light emitting signal generators 410_1-410_*k* outputs its own odd-numbered light emitting signal and inverted light emitting signal to the neighboring (next) second light emitting signal generator of the second light emitting signal generators 420_1-420_*i*. The second light emitting signal generator receiving these odd-numbered light emitting and inverted light emitting signals then outputs its own even-numbered light emitting signal and inverted light emitting signal to the next first light emitting signal generator. The next first light emitting signal generator then receives these even-numbered light emitting and inverted light emitting signals and the process continues in this fashion.

However, the first light emitting signal generator 410_1, which is the first one of the plurality of the first light emitting signal generators 410_1-410_*k*, receives the synchronization signal FLM and the inverted synchronization signal FLM_B in place of the even-numbered light emitting signal and inverted light emitting signal that would otherwise be output from the neighboring (previous) second light emitting signal generator.

In operation, the first light emitting signal generator 410_1 selects one of a first voltage VGH and a second voltage VGL according to the synchronization signal FLM and the inverted synchronization signal FLM_B at the edge timing of the first light emitting clock signal EM_CLK1 to generate the light emitting signal EM1, and blocks or receives the clock signal CLK according to the inverted synchronization signal FLM_B to generate an inverted light emitting signal EM1_B. Then, one by one, each of remaining first light emitting signal generators 410_2-410_*k* generates its own odd-numbered light emitting signal according to the even-numbered light emitting signal and the even-numbered inverted light emitting signal that are output from the neighboring (previous) second light emitting signal generator, and generates its own odd-numbered inverted light emitting signal by blocking or receiving the clock signal CLK according to the even-numbered inverted light emitting signal that is output from the neighboring second light emitting signal generator.

Here, the voltage levels of the first voltage VGH and the second voltage VGL are determined according to the light emission control transistor M3. An exemplary embodiment, where the first voltage VGH is the high voltage (hereinafter high level) and the second voltage VGL is the low voltage (hereinafter low level), is described in examples below.

In similar fashion, each of the second light emitting signal generators **420_1-420_*i*** generates its own even-numbered light emitting signal according to the odd-numbered light emitting signal and the odd-numbered inverted light emitting signal that are output from the neighboring (previous) first light emitting signal generator, and generates its own even-numbered inverted light emitting signal by blocking or receiving the inverted clock signal CLKB according to the odd-numbered inverted light emitting signal that is output from the neighboring first light emitting signal generator.

The detailed operations of the first and second light emitting signal generators **410_1-410_*k* and 420_1-420_*i* will now be described with reference to FIG. 4**.

Figure 4:
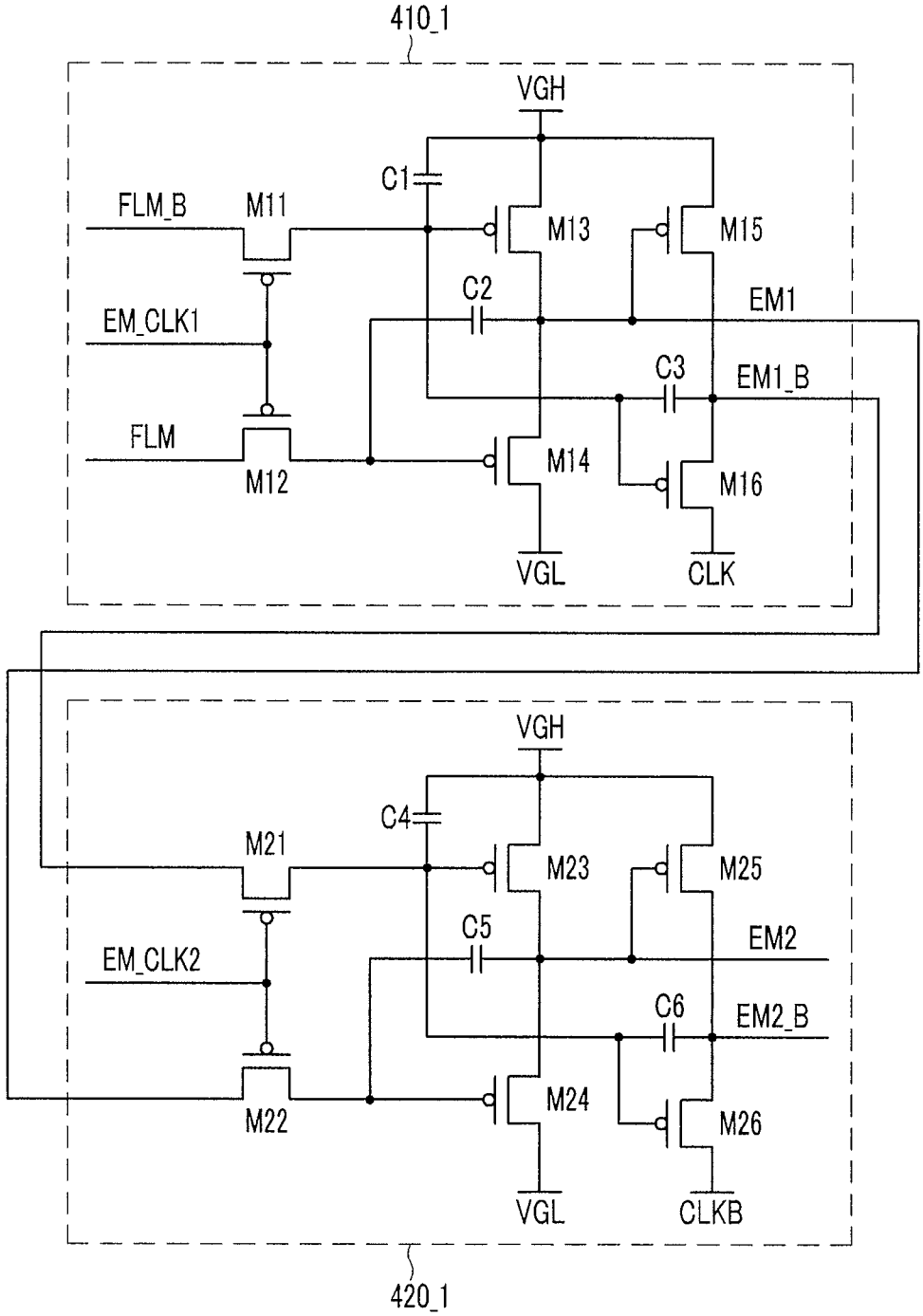
FIG. 4 is a detailed circuit diagram of the first light emitting signal generator 410_1 and the second light emitting signal generator 420_1 shown in FIG. 3.

FIG. 4 is a detailed circuit diagram of the first light emitting signal generator 410_1 and the second light emitting signal generator 420_1 shown in FIG. 3. For better understanding and ease of description, FIG. 4 shows the first light emitting signal generator 410_1 and the second light emitting signal generator 420_1, however the circuit configuration of the remaining first and second light emitting signal generators **410_2-410_*k* and 420_2-420_*i*** is substantially the same.

Referring to FIG. 4, the first light emitting signal generator 410_1 includes a plurality of transistors M11-M16 and a plurality of capacitors C1-C3. The plurality of transistors M11-M16 according to an exemplary embodiment are realized through PMOS transistors.

The source terminal of the transistor M11 receives the inverted synchronization signal FLM_B, and the gate terminal of the transistor M11 receives the first light emitting clock signal EM_CLK1. The source terminal of the transistor M12 receives the synchronization signal FLM, and the gate terminal of the transistor M12 receives the first light emitting clock signal EM_CLK1.

The gate terminal of the transistor M13 is coupled to the drain terminal of the transistor M11, the source terminal of the transistor M13 receives the first voltage VGH, and the drain terminal of the transistor M13 outputs the light emitting signal EM1. The gate terminal of the transistor M14 is coupled to the drain terminal of the transistor M12, the drain terminal of the transistor M14 receives the second voltage VGL, and the source terminal of the transistor M14 outputs the light emitting signal EM1.

The gate terminal of the transistor M15 receives the light emitting signal EM1, the source terminal of the transistor M15 receives the first voltage VGH, and the drain terminal of the transistor M15 outputs the inverted light emitting signal EM1_B. The gate terminal of the transistor M16 is coupled to the drain terminal of the transistor M11, the drain terminal of the transistor M16 receives the clock signal CLK, and the source terminal of the transistor M16 outputs the inverted light emitting signal EM1_B.

The first capacitor C1 is coupled between the drain terminal of the transistor M11 and the source terminal of the transistor M13. The second capacitor C2 is coupled between the drain terminal of the transistor M12 and the source terminal of the transistor M14. The third capacitor C3 is coupled between the gate terminal and the source terminal of the transistor M16.

The second light emitting signal generator 420_1 includes a plurality of transistors M21-M26 and a plurality of capacitors C4-C6. The plurality of transistors M21-M26 according to an exemplary embodiment are realized through PMOS transistors.

Here, the source terminal of the transistor M21 receives the inverted light emitting signal EM1_B, and the gate terminal of the transistor M21 receives the second light emitting clock signal EM_CLK2. The source terminal of the transistor M22 receives the light emitting signal EM1, and the gate terminal of the transistor M22 receives the second light emitting clock signal EM_CLK2.

The gate terminal of the transistor M23 is coupled to the drain terminal of the transistor M21, the source terminal of the transistor M23 receives the first voltage VGH, and the drain terminal of the transistor M23 outputs the light emitting signal EM2. The gate terminal of the transistor M24 is coupled to the drain terminal of the transistor M22, the drain terminal of the transistor M24 receives the second voltage VGL, and the source terminal of the transistor M24 outputs the light emitting signal EM2.

The gate terminal of the transistor M25 receives the light emitting signal EM2, the source terminal of the transistor M25 receives the first voltage VGH, and the drain terminal of the transistor M25 outputs the inverted light emitting signal EM2_B. The gate terminal of the transistor M26 is coupled to the drain terminal of the transistor M21, the drain terminal of the transistor M26 receives the inverted clock signal CLKB, and the source terminal of the transistor M26 outputs the inverted light emitting signal EM2_B.

The fourth capacitor C4 is coupled between the drain terminal of the transistor M21 and the source terminal of the transistor M23. The fifth capacitor C5 is coupled between the drain terminal of the transistor M22 and the source terminal of the transistor M24. The sixth capacitor C6 is coupled between the source terminal and the gate terminal of the transistor M26.

Figure 5:
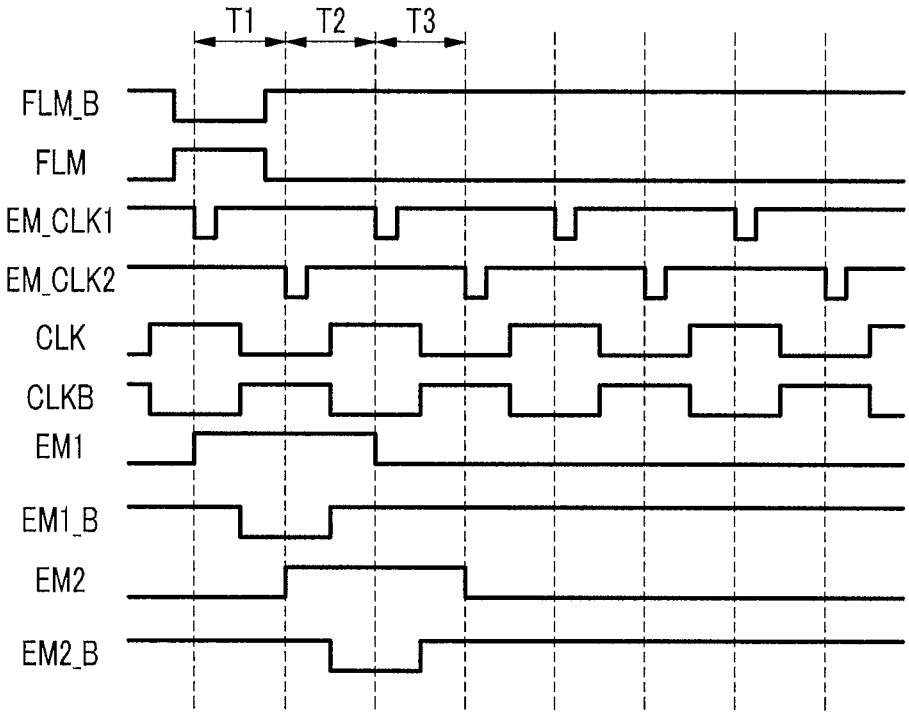
FIG. 5 is a timing diagram for explaining an operation of the light emission driver 400 according to an exemplary embodiment.

FIG. 5 is a timing diagram for explaining an operation of the light emission driver 400 according to an exemplary embodiment. In FIG. 5, a period T1 is a period from the time when the first light emitting clock signal EM_CLK1 becomes low level to the time when the second light emitting clock signal EM_CLK2 becomes low level. A period T2 is a period from the time when the second light emitting clock signal EM_CLK2 becomes low level to the time when the first light emitting clock signal EM_CLK1 becomes low level. Also, a period T3 is a period from the time when the first light emitting clock signal EM_CLK1 becomes low level to the time when the second light emitting clock signal EM_CLK2 becomes low level.

Referring to FIGS. 4-5, when the synchronization signal FLM is generated as a high-level pulse, the first light emitting clock signal EM_CLK1 and the second light emitting clock signal EM_CLK2 are then generated. Next, during the period T1, the transistors M11 and M12 are turned on in synchronization with the falling edge of the first light emitting clock signal EM_CLK1. Thus, the transistors M13 and M16 are turned on by the inverted synchronization signal FLM_B, and the transistors M14 and M15 are turned off by the synchronization signal FLM. Thus, the first voltage VGH is output as the light emitting signal EM1, and the clock signal CLK is output as the inverted light emitting signal EM1_B.

Later in the period T1, when the first light emitting clock signal EM_CLK1 has high level, the transistors M11 and M12 are turned off. Here, the voltage difference between the gate terminal and the source terminal of the transistors M13, M14, and M16 is maintained by the first through third capacitors C1-C3. Accordingly, during the periods T1 and T2, the light emitting signal EM1 and the inverted light emitting signal EM1_B are subsequently output.

Next, during the period T2, the transistors M21 and M22 are turned on in synchronization with the falling edge of the second light emitting clock signal EM_CLK2. Thus, the transistors M23 and M26 are turned on by the inverted light emitting signal EM1_B, and the transistors M24 and M25 are turned off by the light emitting signal EM1. Thus, the first voltage VGH is output as the light emitting signal EM2, and the inverted clock signal CLKB is output as the inverted light emitting signal EM2_B.

Later in the period T2, the transistors M21 and M22 are turned off when the first light emitting clock signal EM_CLK2 has high level. Here, the voltage difference between the gate terminal and the source terminal of the transistors M23, M24, and M26 is maintained by the fourth through sixth capacitors C4-C6. Accordingly, during the periods T2 and T3, the light emitting signal EM2 and the inverted light emitting signal EM2_B are subsequently output.

Next, during the period T3, the transistors M11 and M12 are turned on in synchronization with the falling edge of the first light emitting clock signal EM_CLK1. Here, the synchronization signal FLM has low level and the inverted synchronization signal FLM_B has high level such that the transistors M13 and M16 are turned off and the transistors M14 and M15 are turned on. Thus, the second voltage VGL is output as the light emitting signal EM1, and the first voltage VGH is output as the inverted light emitting signal EM1_B.

That is, the odd-numbered light emitting signals of the light emitting signals EM1-EMn are sequentially output as high-level pulse signals corresponding to sequential periods of the first light emitting clock signal EM_CLK1. Also, the clock signal CLK is sampled during these sequential periods of the first light emitting clock signal EM_CLK1 such that the odd-numbered inverted light emitting signals corresponding to the odd-numbered light emitting signals of the light emitting signals EM1-EMn are sequentially output.

Likewise, the even-numbered light emitting signals of the light emitting signals EM1-EMn are sequentially output as high-level pulse signals corresponding to sequential periods of the second light emitting clock signal EM_CLK2. Also, the inverted clock signal CLKB is sampled during these sequential periods of the second light emitting clock signal EM_CLK2 such that the even-numbered inverted light emitting signals corresponding to the even-numbered light emitting signals of the light emitting signals EM1-EMn are sequentially output. Accordingly, periods of the first and second light emitting clock signals EM_CLK1 and EM_CLK2 are controlled such that corresponding pulse widths of the light emitting signals EM1-EMn may be controlled.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and their equivalents.

What is claimed is:

1. A display device comprising:

a display unit comprising a plurality of scan lines for transmitting a plurality of scan signals, a plurality of data lines for transmitting a plurality of data signals, a plurality of light emitting signal lines for transmitting a plurality of light emitting signals, and a plurality of pixels coupled to the scan lines and the data lines and for emitting light according to the light emitting signals; and a light emission driver for transmitting the light emitting signals to the light emitting signal lines, and for controlling a pulse width of the light emitting signals, wherein the light emission driver is configured to:

receive a synchronization signal for limiting a maximum value of a driving current flowing to the pixels, a first light emitting clock signal in synchronization with the synchronization signal, a second light emitting clock signal in synchronization with the synchronization signal and having the same frequency as the first light emitting clock signal and a phase difference from the first light emitting clock signal, a clock signal having the same frequency as the first light emitting clock signal, and an inverted clock signal of the clock signal;

sequentially generate a plurality of first light emitting signals during a plurality of first light emitting clock signal periods, and generate a plurality of first inverted light emitting signals by sampling the clock signal during the first light emitting clock signal periods, in synchronization with edge timing of the first light emitting clock signal; and sequentially generate a plurality of second light emitting signals during a plurality of second light emitting clock signal periods, and generate a plurality of second inverted light emitting signals by sampling the inverted clock signal during the second light emitting clock signal periods, in synchronization with edge timing of the second light emitting clock signal.

2. The display device of claim 1, wherein:

the light emission driver comprises a plurality of first light emitting signal generators for generating the first light emitting signals and a plurality of second light emitting signal generators for generating the second light emitting signals, and one of the first light emitting signal generators is configured to:

receive a corresponding second light emitting signal of the second light emitting signals and a corresponding second inverted light emitting signal of the second inverted light emitting signals, select a first voltage or a second voltage according to the corresponding second light emitting signal and the corresponding second inverted light emitting signal at the edge timing of the first light emitting clock signal to generate a first light emitting signal of the first light emitting signals, and block or receive the clock signal according to the corresponding second inverted light emitting signal to generate a first inverted light emitting signal of the first inverted light emitting signals.

3. The display device of claim 2, wherein the one of the first light emitting signal generators comprises:

a first transistor having a source terminal for receiving the corresponding second inverted light emitting signal and a gate terminal for receiving the first light emitting clock signal;

a second transistor having a gate terminal coupled to a drain terminal of the first transistor, a source terminal for receiving the first voltage, and a drain terminal for outputting the first light emitting signal;

a third transistor having a gate terminal for receiving the first light emitting signal, a source terminal for receiving the first voltage, and a drain terminal for outputting the first inverted light emitting signal;

a fourth transistor having a source terminal for receiving the corresponding second light emitting signal and a gate terminal for receiving the first light emitting clock signal;

a fifth transistor having a gate terminal coupled to a drain terminal of the fourth transistor, a drain terminal for receiving the second voltage, and a source terminal for outputting the first light emitting signal;

a sixth transistor having a gate terminal coupled to the drain terminal of the first transistor, a drain terminal for receiving the clock signal, and a source terminal for outputting the first inverted light emitting signal;

a first capacitor coupled between the drain terminal of the first transistor and the source terminal of the second transistor;

a second capacitor coupled between the drain terminal of the fourth transistor and the source terminal of the fifth transistor; and a third capacitor coupled between the gate terminal and the source terminal of the sixth transistor.

4. The display device of claim 3, wherein the first through sixth transistors are PMOS transistors.

5. The display device of claim 2, wherein another of the first light emitting signal generators, for generating an initial first light emitting signal of the first light emitting signals, is configured to receive the synchronization signal, and to receive an inverted synchronization signal.

6. The display device of claim 2, wherein one of the second light emitting signal generators is configured to:

receive a corresponding first light emitting signal of the first light emitting signals and a corresponding first inverted light emitting signal of the first inverted light emitting signals, select a third voltage or a fourth voltage according to the corresponding first light emitting signal and the corresponding first inverted light emitting signal at the edge timing of the second light emitting clock signal to generate a second light emitting signal of the second light emitting signals, and block or receive the inverted clock signal according to the corresponding first inverted light emitting signal to generate a second inverted light emitting signal of the second inverted light emitting signals.

7. The display device of claim 6, wherein the one of the second light emitting signal generators comprises:

a seventh transistor having a source terminal for receiving the corresponding first inverted light emitting signal and a gate terminal for receiving the second light emitting clock signal;

an eighth transistor having a gate terminal coupled to a drain terminal of the seventh transistor, a source terminal for receiving the third voltage, and a drain terminal for outputting the second light emitting signal;

a ninth transistor having a gate terminal for receiving the second light emitting signal, a source terminal for receiving the third voltage, and a drain terminal for outputting the second inverted light emitting signal;

a tenth transistor having a source terminal for receiving the corresponding first light emitting signal and a gate terminal for receiving the second light emitting clock signal;

an eleventh transistor having a gate terminal coupled to a drain terminal of the tenth transistor, a drain terminal for receiving the fourth voltage, and a source terminal for outputting the second light emitting signal;

a twelfth transistor having a gate terminal coupled to the drain terminal of the seventh transistor, a drain terminal for receiving the inverted clock signal, and a source terminal for outputting the second inverted light emitting signal;

a fourth capacitor coupled between the drain terminal of the seventh transistor and the source terminal of the eighth transistor;

a fifth capacitor coupled between the drain terminal of the tenth transistor and the source terminal of the eleventh transistor; and a sixth capacitor coupled between the gate terminal and the source terminal of the twelfth transistor.

8. The display device of claim 7, wherein the seventh through twelfth transistors are PMOS transistors.

9. A display device comprising:

a display unit comprising a plurality of scan lines for transmitting a plurality of scan signals, a plurality of data lines for transmitting a plurality of data signals, a plurality of light emitting signal lines for transmitting a plurality of light emitting signals, and a plurality of pixels coupled to the scan lines and the data lines and for emitting light according to the light emitting signals;

a plurality of first light emitting signal generators for generating a plurality of first light emitting signals of the light emitting signals corresponding to odd-numbered light emitting signal lines of the light emitting signal lines; and a plurality of second light emitting signal generators for generating a plurality of second light emitting signals of the light emitting signals corresponding to even-numbered light emitting signal lines of the light emitting signal lines, wherein one of the first light emitting signal generators is configured to control a pulse width of one of the first light emitting signals by using a first light emitting clock signal, and one of the second light emitting signals from one of the second light emitting signal generators; and the one of the second light emitting signal generators is configured to control a pulse width of the one of the second light emitting signals by using a second light emitting clock signal having a same frequency as the first light emitting clock signal and a phase difference from the first light emitting clock signal, and an other of the first light emitting signals from an other of the first light emitting signal generators, wherein the first light emitting signal generators are configured to:

receive a clock signal having the same frequency as the first light emitting clock signal, and respectively sample the clock signal during one period of the first light emitting clock signal to sequentially generate a plurality of first inverted light emitting signals, wherein the second light emitting signal generators are configured to:

receive an inverted clock signal that is inverted with respect to the clock signal, and respectively sample the inverted clock signal during one period of the second light emitting clock signal to sequentially generate a plurality of second inverted light emitting signals.

10. The display device of claim 9, wherein the one of the first light emitting signal generators is configured to select a first voltage or a second voltage according to the one of the second light emitting signals and one of the second inverted light emitting signals from the one of the second light emitting signal generators in synchronization with edge timing of the first light emitting clock signal to generate the one of the first light emitting signals.

11. The display device of claim 10, wherein the one of the first light emitting signal generators comprises:

a first transistor having a source terminal for receiving the one of the second inverted light emitting signals and a gate terminal for receiving the first light emitting clock signal;

a second transistor having a gate terminal coupled to a drain terminal of the first transistor, a source terminal for receiving the first voltage, and a drain terminal for outputting the one of the first light emitting signals;

a third transistor having a gate terminal for receiving the one of the first light emitting signals, a source terminal for receiving the first voltage, and a drain terminal for outputting one of the first inverted light emitting signals;

a fourth transistor having a source terminal for receiving the one of the second light emitting signals and a gate terminal for receiving the first light emitting clock signal;

a fifth transistor having a gate terminal coupled to a drain terminal of the fourth transistor, a drain terminal for receiving the second voltage, and a source terminal for outputting the one of the first light emitting signals;

a sixth transistor having a gate terminal coupled to the drain terminal of the first transistor, a drain terminal for receiving the clock signal, and a source terminal for outputting the one of the first inverted light emitting signals;

a first capacitor coupled between the drain terminal of the first transistor and the source terminal of the second transistor;

a second capacitor coupled between the drain terminal of the fourth transistor and the source terminal of the fifth transistor; and a third capacitor coupled between the gate terminal and the source terminal of the sixth transistor.

12. The display device of claim 11, wherein the first through sixth transistors are PMOS transistors.

13. The display device of claim 10, wherein the one of the second light emitting signal generators is configured to select a third voltage or a fourth voltage according to the other of the first light emitting signals and an other of the first inverted light emitting signals from the other of the first light emitting signal generators in synchronization with edge timing of the second light emitting clock signal to generate the one of the second light emitting signals.

14. The display device of claim 13, wherein the one of the second light emitting signal generators comprises:

a seventh transistor having a source terminal for receiving the other of the first inverted light emitting signals and a gate terminal for receiving the second light emitting clock signal;

an eighth transistor having a gate terminal coupled to a drain terminal of the seventh transistor, a source terminal for receiving the third voltage, and a drain terminal for outputting the one of the second light emitting signals;

a ninth transistor having a gate terminal for receiving the one of the second light emitting signals, a source terminal for receiving the third voltage, and a drain terminal for outputting the one of the second inverted light emitting signals;

a tenth transistor having a source terminal for receiving the other of the first light emitting signals and a gate terminal for receiving the second light emitting clock signal;

an eleventh transistor having a gate terminal coupled to a drain terminal of the tenth transistor, a drain terminal for receiving the fourth voltage, and a source terminal for outputting the one of the second light emitting signals;

a twelfth transistor having a gate terminal coupled to the drain terminal of the seventh transistor, a drain terminal for receiving the inverted clock signal, and a source terminal for outputting the one of the second inverted light emitting signals;

a fourth capacitor coupled between the drain terminal of the seventh transistor and the source terminal of the eighth transistor;

a fifth capacitor coupled between the drain terminal of the tenth transistor and the source terminal of the eleventh transistor; and a sixth capacitor coupled between the gate terminal and the source terminal of the twelfth transistor.

15. The display device of claim 14, wherein the seventh through twelfth transistors are PMOS transistors.

16. The display device of claim 9, wherein an initial first light emitting signal generator of the first light emitting signal generators, for generating an initial first light emitting signal of the first light emitting signals, controls a pulse width of the initial first light emitting signal by using a synchronization signal for limiting a maximum value of a driving current flowing to the pixels and an inverted synchronization signal that is inverted with respect to the synchronization signal.

17. The display device of claim 16, wherein the first and second light emitting clock signals are generated in synchronization with the synchronization signal.

* * * * *